US007684727B2

(12) United States Patent
Yamanaka et al.

(10) Patent No.: US 7,684,727 B2
(45) Date of Patent: Mar. 23, 2010

(54) IMAGE RECORDING APPARATUS

(75) Inventors: Takashi Yamanaka, Yamatokoriyama (JP); Kimihide Tsukamoto, Osaka (JP); Junya Masuda, Ikoma (JP); Yoshinori Shiraishi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 669 days.

(21) Appl. No.: 11/555,296

(22) Filed: Nov. 1, 2006

(65) Prior Publication Data

US 2007/0104507 A1 May 10, 2007

(30) Foreign Application Priority Data

Nov. 7, 2005 (JP) ..... 2005-322541
Jan. 24, 2006 (JP) ..... 2006-014993

(51) Int. Cl.
*G03G 15/00* (2006.01)

(52) U.S. Cl. ..... 399/110; 399/122; 399/328

(58) Field of Classification Search ..... 399/107, 399/110, 122, 320, 328; 219/216
See application file for complete search history.

(56) References Cited

U.S. PATENT DOCUMENTS 4,910,551 A * 3/1990 Onoda et al. ..... 399/9
5,797,068 A * 8/1998 Otsuki et al. ..... 399/110
5,822,668 A * 10/1998 Fromm et al. ..... 399/323

FOREIGN PATENT DOCUMENTS

| | | |
|---|---|---|
| JP | 01-162648 A | 6/1989 |
| JP | 05-127559 | 5/1993 |
| JP | 09-134050 | 5/1997 |
| JP | 10-020702 | 1/1998 |
| JP | 2004-053653 | 2/2004 |

* cited by examiner

*Primary Examiner*—David P Porta
*Assistant Examiner*—Benjamin Schmitt
(74) *Attorney, Agent, or Firm*—Renner, Otto, Boisselle & Sklar, LLP

(57) ABSTRACT

An image recording apparatus includes a first unit, a second unit, and a fusing device for fusing and fixing a toner image on a sheet. The device has a heat roller; a pressure roller; and a contact member placed in contact with the heat roller. The first unit is movable, along a first direction, to be drawn out of the apparatus. With the first unit out of the apparatus, the second unit is movable, along a second direction perpendicular to the first direction, to be drawn out of the first unit. The device is divided into a first and a second portions where the pressure and heat rollers and the member are respectively located. The first and second portions are supported on the first and second units, respectively. The second portion is detachable from the first portion when the second unit is drawn out from the first unit.

11 Claims, 12 Drawing Sheets

IMAGE RECORDING APPARATUS

CROSS REFERENCE

This Nonprovisional application claims priority under 35 U.S.C. §119(a) on Patent Applications No. 2005-322541 and 2006-014993 filed in Japan on Nov. 7, 2005 and Jan. 24, 2006, respectively, the entire contents of which are hereby incorporated by reference.

BACKGROUND OF THE INVENTION

The invention relates to an image recording apparatus for recording an image on a sheet while transporting the sheet on a sheet transport path.

In electrophotographic image recording apparatus, a sheet is fed from a sheet feeding tray to an image recording section where an image is formed on the sheet. Then the sheet is output to a sheet output tray. A sheet may become jammed on its way on a sheet transport path. A sheet jam is likely to occur particularly in the image recording section. This is because a sheet tends to be curled while undergoing various processes in the image recording section, such as a developer-image transfer process performed by a transfer device or a fusing process performed by a fusing device.

A sheet jam is also likely to occur in a reversing transport path on which, in duplex image formation (an image is formed on both sides of a sheet), a sheet with an image formed on a first side is reversed and transported back to the image recording section. This is because the duplex image formation involves a sheet passing through many bifurcations of the sheet transport path.

In the event of a sheet jam, image recording apparatus suspend an image forming process until all sheets present on the sheet transport path are removed. JP H09-134050A discloses that a sheet jammed in the image recording section is removed by drawing the image recording section in a forward direction out of the image recording apparatus and opening a side wall or the like of the section to expose the sheet transport path.

The foregoing configuration of the prior art apparatus, however, involves a small level of exposure of a portion of the sheet transport path located in the image recoding section, even with the image recording section drawn out and the side wall opened. Thus, this configuration renders it hard for a user to remove a jammed sheet. In particular, recent image recording apparatus with high functionality have a complex configuration that renders it hard to provide a large space for removing a jammed sheet.

In consecutive image formation that involves a plurality of sheets present on the sheet transport path, a user is necessitated, if only a small level of exposure of sheet transport path is available, to open side walls or the like of different portions of the image recording section in order to check if all the sheets are removed from the sheet transport path.

As a solution to the foregoing problem, image recording apparatus has been proposed that includes a movable first unit and a movable second unit. In the first unit, a first path as part of a sheet transport path is positioned. The first unit is movable along a first direction toward front of the apparatus, to be drawn out of the apparatus. With the first unit drawn out of the apparatus, the second unit is movable along a second direction, perpendicular to the first direction, to be drawn out of the first unit. In the second unit, a second path as another part of the sheet transport path is positioned.

The proposed apparatus eliminate the need for a dedicated space for drawing the second unit out of the first unit along the second direction, since existing space for removing a printed sheet also serves as the space for drawing the unit 2 out of the unit 1. Also, the proposed apparatus allow the second unit to be detached from the first unit by being drawn out of the first unit, thereby enabling the first and second paths to have a greater exposed area than in conventional apparatus where the first and second units are integrated in a single unit.

In the first unit, further, a fusing device is located along the first path. The fusing device has: a heat roller for fusing a toner image formed on a sheet; and a pressure roller, pressed against the heat roller, for applying pressure to the sheet. When the first unit is drawn out of the apparatus, part of the exterior of the fusing device is exposed. The fusing device also has sheet removers positioned in contact with respective circumferential surfaces of the heat and pressure rollers.

Additionally, the entire fusing device is covered with a covering under which components such as described above are fixedly positioned. The covering is provided because the components of the fusing device are hot due to the heat of the heat roller, compared with components of the other devices. The covering prevents the other devices from overheating, and also serves to maintain the circumferential surface of the heat roller at a constant temperature.

The configuration of the proposed apparatus, however, makes it difficult for a user to remove a sheet jammed in the fusing device, and all the more difficult because of the heat of the fusing device. In recent image recording apparatus that feature high-speed printing capabilities, it is impossible to stop rotation of transport rollers quickly in the event of a sheet jam, and a jammed sheet is transported forward until the transport rollers come to a stop. Thus, a jammed sheet sometimes becomes entangled in between the heat roller and the pressure roller, even when the sheet jam occurs in a location other than the fusing device. Therefore, it is important to make it easier to remove a sheet jammed in the fusing device.

A possible solution is to allow a contact member, such as a sheet remover, that is placed in contact with the circumferential surface of the heat roller to be detached from the circumferential surface as necessary so that the circumferential surface is exposed. However, the proposed image recording apparatus requires two steps to move the contact member: first, draw the second unit out of the first unit to make space for the contact member to move; and only then, move the contact member.

A feature of the invention is to provide an image recording apparatus that facilitates removal of a sheet jammed in a fusing device positioned in a first unit.

SUMMARY OF THE INVENTION

An image recording apparatus according to an aspect of the invention includes a fusing device, a first unit, and a second unit. The fusing device has a heat roller for fusing the toner image; a pressure roller, pressed against the heat roller, for applying pressure to the sheet; and a contact member placed in contact with the heat roller. The fusing device fixes the toner image on the sheet being transported between the heat roller and the pressure roller. The first unit is movable, along a first direction toward front of the apparatus, to be drawn out of the apparatus. The second unit is mounted in the first unit. With the first unit drawn out of the apparatus, the second unit is movable, along a second direction that is perpendicular to the first direction, to be drawn out of the first unit. The fusing device is divided into a first portion where the pressure and heat rollers are located and a second portion where the contact member is located. The first portion is supported on the first unit. The second portion is supported on the second unit in such a manner as to be detached from the first portion when the second unit is drawn out from the first unit.

DETAILED DESCRIPTION OF THE INVENTION

Figure 1:
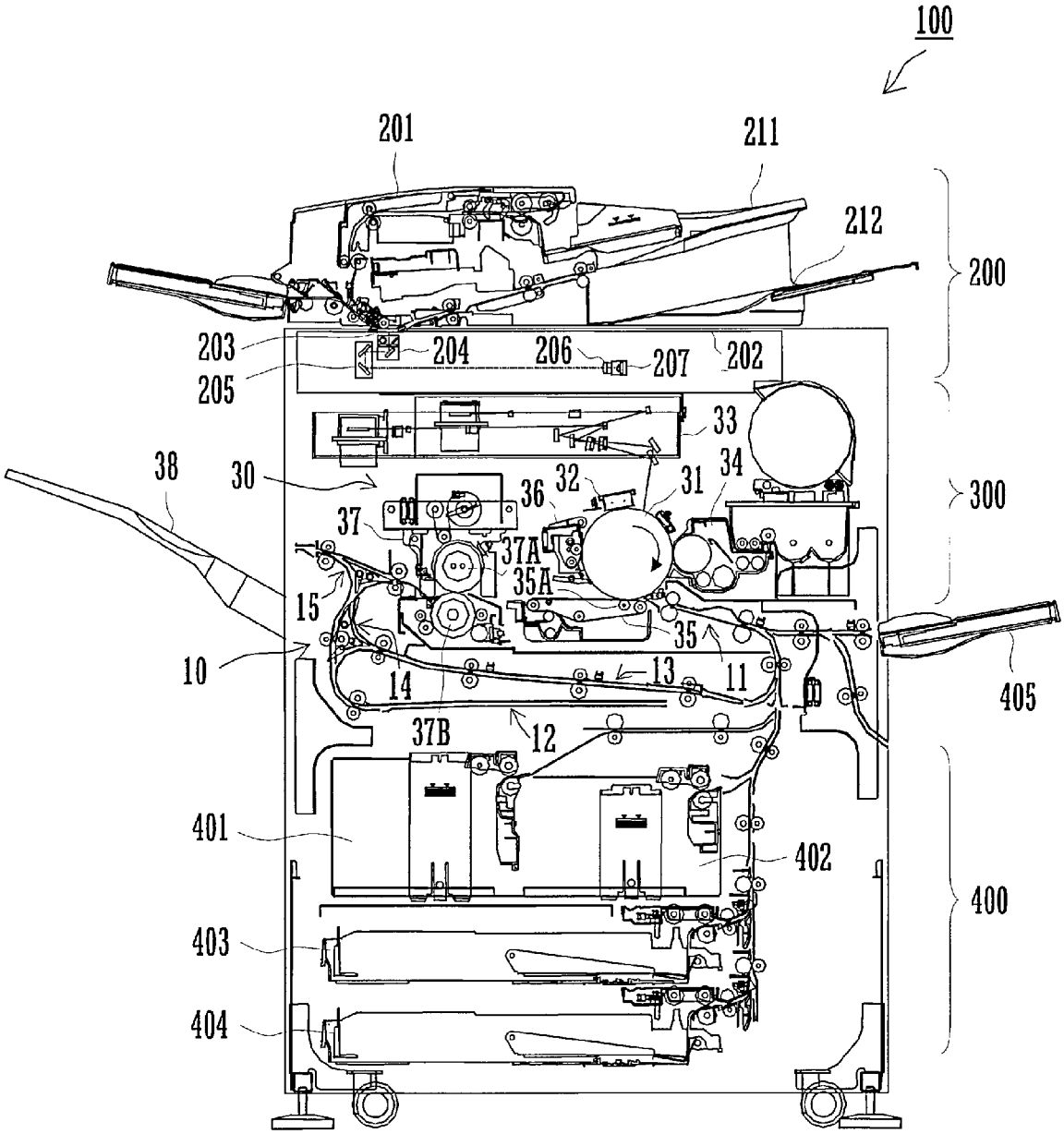
FIG. 1 is a schematic front cross-sectional view illustrating a configuration of an image recording apparatus according to an embodiment of the invention.

FIG. 1 is a schematic front cross-sectional view illustrating a configuration of an image recording apparatus according to a first embodiment of the invention, such as an apparatus 100. The apparatus 100 includes an image reading unit 200, an image forming unit 300, and a sheet feeding unit 400.

The unit 200 has an automatic document feeder (ADF) 201, a first document platen 202, a second document platen 203, a first mirror base 204, a second mirror base 205, a lens 206, and a charge coupled device (CCD) 207.

The ADF 201 feeds an original document, sheet by sheet, from a document tray 211 through the second document platen 203 to a first output tray 212. The ADF 201 is mounted so as to be pivotable about a rear-end pivot between an open position and a closed position. In the closed position, the ADF 201 covers the platen 202. The ADF 201 is pivoted upward to the open position to expose the platen 202, so that a user can place an original document manually on the platen 202.

Each of the platens 202 and 203 includes a hard glass plate.

The bases 204 and 205 are provided below the platens 202 and 203 so as to be movable horizontally. The base 205 moves half as fast as the base 204. On the base 204, a light source and a first mirror are mounted. On the base 205, a second mirror and a third mirror are mounted.

In reading an image of original document that is being transported by the ADF 201, the base 204 is held still below the platen 203. While passing on the platen 203, an original document is irradiated with light from the light source. The reflected light is in turn reflected from the first mirror to the base 205.

In reading an image of original document placed on the platen 202, the bases 204 and 205 are moved horizontally below the platen 202. An original document placed on the platen 202 is irradiated with light from the light source. The reflected light is in turn reflected from the first mirror to the base 205.

Regardless of whether an original document is fed by the ADF 201 or placed on the platen 202, thus, the reflected light from the original document is in turn reflected from the second and third mirrors, and then strikes the CCD 207 through the lens 206.

The CCD 207 outputs electric signals according to an amount of the reflected light from the original document. The electric signals are input to the image forming unit 300 as image data.

The unit 300 is provided with an image recording section 30. The section 30 includes a photoreceptor drum 31, a charging device 32, an exposure device 33, a developing device 34, a transfer belt 35, a cleaner 36, and a fusing device 37.

The drum 31, which has an outer photoreceptive surface, is rotatable in a direction indicated by an arrow. The charging device 32 applies, to the surface of the drum 31, such a voltage as to allow the surface to have a uniform electric potential. The device 32 may be either a noncontact charger, or a contact charger of roller or brush type.

The exposure device 33 irradiates the surface of the drum 31 with light modulated according to image data, so that an electrostatic latent image is formed on the surface. The device 33 has a polygon mirror through which to scan the drum 31 axially with a laser light modulated according to image data. Alternatively, an exposure device provided with an array of light emitting elements such as ELs or LEDs may be used as the device 33.

The developing device 34 supplies toner to the surface of the drum 31 and develops the electrostatic latent image into a toner image.

Under the drum 31, the transfer belt 35 is looped over a plurality of rollers. The belt 35 has a resistance of $1*10^9$ Ω·cm to $1*10^{13}$ Ω·cm. Inside the loop of the belt 35, a transfer roller 35A is provided so as to be pressed against the drum 31 through the belt 35. A predetermined amount of transfer voltage is applied to the roller 35A, so that a toner image is transferred from the drum 31 to a sheet that passes between the belt 35 and the drum 31.

The cleaner 36 removes residual toner that remains on the drum 31 after a toner image is transferred from the drum 31 to a sheet.

The fusing device 37 has a heat roller 37A and a pressure roller 37B. The roller 37A is heated, by an internal heater, to a sufficient temperature to melt toner. The roller 37B is pressed against the roller 37A at a predetermined pressure. The device 37 heats and pressurizes a sheet passing between the rollers 37A and 37B, thereby firmly fixing a toner image to the sheet. After passing through the device 37, a sheet is output to a second output tray 38 mounted on a side surface of the apparatus 100. The tray 38 corresponds to the sheet output section of the Claims.

The sheet feeding unit 400 has sheet cassettes 401, 402, 403, and 404, and a manual sheet feeding tray 405. Each of the cassettes 401 to 404 holds a plurality of sheets of the same size. The tray 405 is provided for holding sheets of sizes and types that are used infrequently.

The unit 400 feeds sheets, one by one, from any one of the cassettes 401 to 404 and the tray 405. A sheet fed by the unit 400 is transported to the image recording section 30 along a sheet transport path 10 to be described below.

Figure 2:
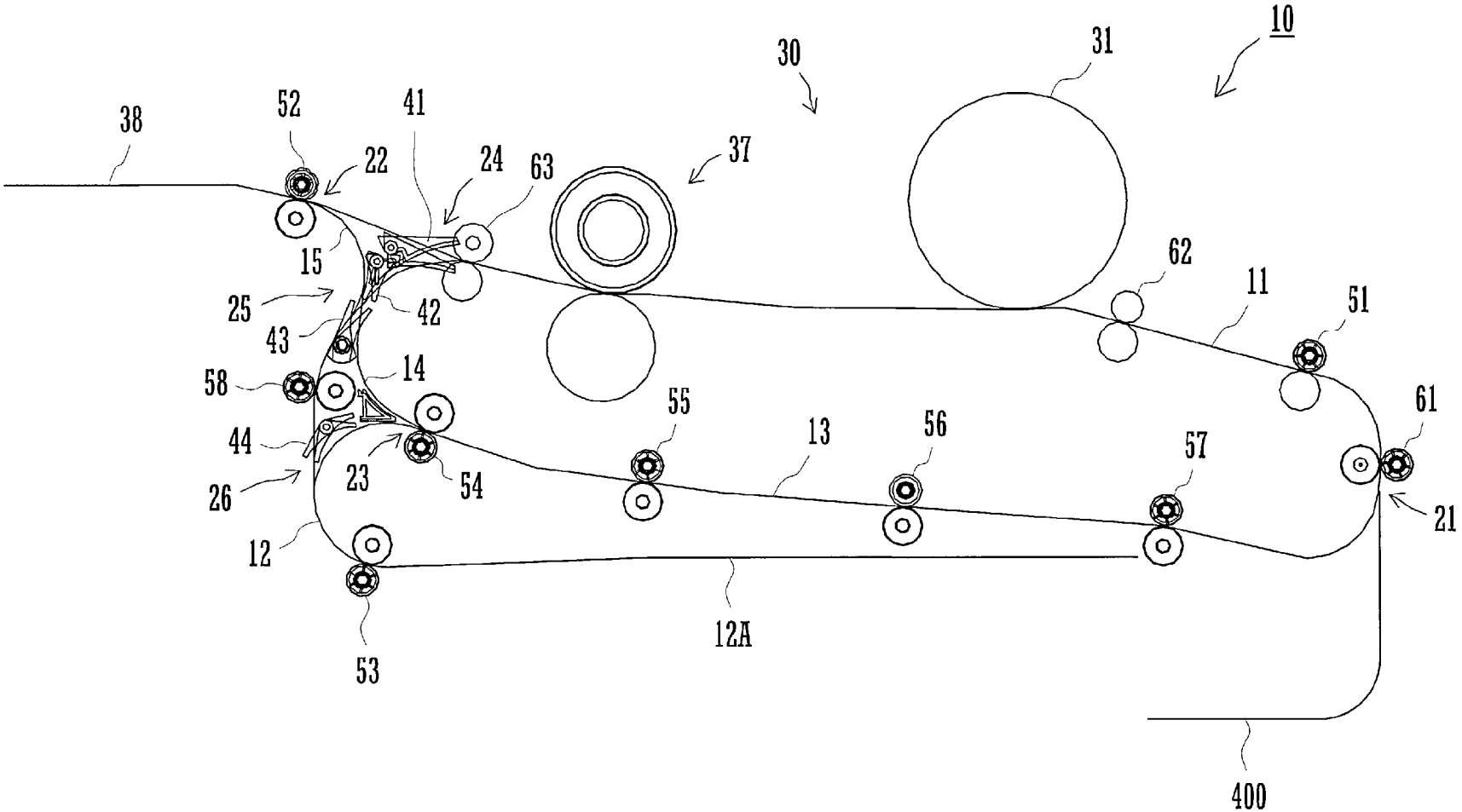
FIG. 2 is a diagram illustrating a configuration of a sheet transport path provided in the apparatus.

FIG. 2 is a diagram illustrating a configuration of the sheet transport path 10. The path 10 is provided inside the image forming unit 300. The path 10 includes a first path 11, a second path 12, a third path 13, a fourth path 14, and a fifth path 15.

The first path 11 leads from the unit 400 to the tray 38, through a first confluence 21, the section 30, a first bifurcation 24, and a second confluence 22 in that order. Arranged along the path 11 are transport rollers 61, 62, and 63, a registration roller 51, and an output roller 52. The transport rollers 61 to 63, the registration roller 51, and the output roller 52 are driven by a first motor (not shown).

A portion of the path 11 located in the section 30 is in an approximately horizontal position. In the portion, the belt 35 is arranged for stable transfer of toner image from the drum 31 to a sheet and for stable transport of a sheet with a pre-fusion toner image electrostatically attracted thereto.

The first bifurcation 24 is located between the section 30 and the tray 38. The second path 12 leads from the bifurcation 24 to a switchback section 12A, through a second bifurcation 25 and a third bifurcation 26 in that order. The section 12A is located below and parallel to the portion of the path 11 located in the section 30. The section 12A transports a sheet forwards and backwards therealong. Along the path 12, there are provided reversing rollers 53 and 58. The rollers 53 and 58 are selectively driven in a forward direction or a backward direction through a first clutch (not shown) by a second motor (also not shown).

The third path 13 leads from the third bifurcation 26 to the first confluence 21 through a third confluence 23. Along the path 13, transport rollers 54, 55, 56, and 57 are arranged. The rollers 54 to 57 are selectively driven in a forward direction or a backward direction through a second clutch (not shown) by a third motor (also not shown).

The fourth path 14 leads from the bifurcation 25 to the confluence 23. The fifth path 15 leads from the bifurcation 25 to the confluence 22.

The section 12A is located below and parallel to the portion of the path 11 located in the section 30. The path 13 is located between the section 12A and the portion of the path 11 located in the section 30.

Figure 3:
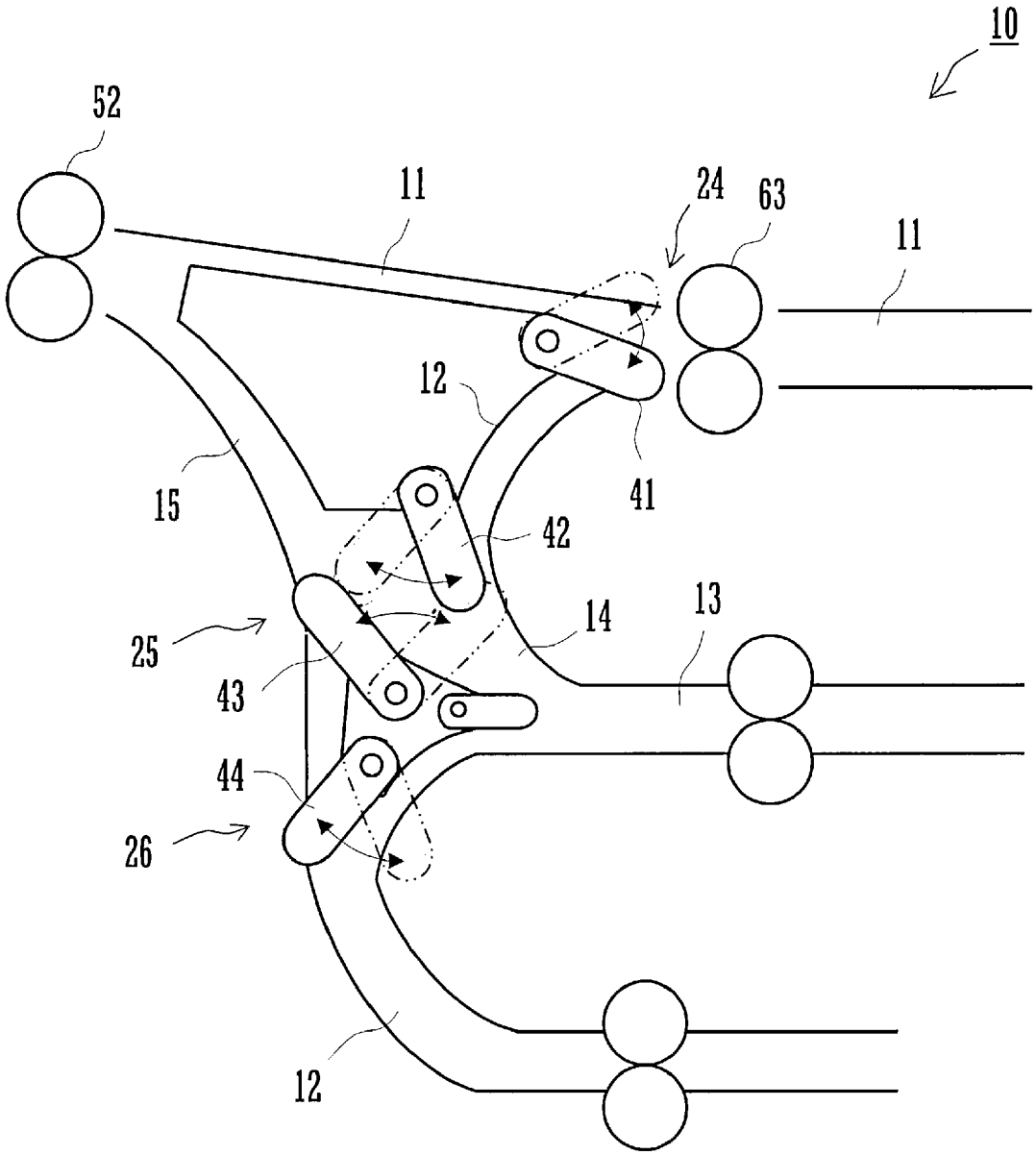
FIG. 3 is a diagram illustrating a configuration of each of first, second, and third bifurcations of the sheet transport path.

FIG. 3 is a diagram illustrating a configuration of each of the first bifurcation 24, the second bifurcation 25, and the third bifurcation 26, of the sheet transport path 10. A guide 41 is provided at the bifurcation 24. The guide 41 is pivoted between two respective positions indicated by a solid line and a chain double-dashed line by a first solenoid (not shown), to guide a sheet from the bifurcation 24 into either one of the paths 11 and 12.

Guides 42 and 43 are provided at the bifurcation 25. With no external force acting thereon, the guide 42 is located in a position, indicated by a solid line, to guide a sheet into the path 15 as the sheet is transported upward along the path 12 or the path 14. The guide 42 prevents a sheet from being guided into the path 12 as the sheet is transported upward along the path 12 or the path 13.

The guide 43 is pivoted between two respective positions indicated by a solid line and a chain double-dashed line by activating and deactivating a second solenoid (not shown), to allow, in the bifurcation 25, passage of a sheet from the path 14 to the path 15 or from the path 12 to the path 15.

The guide 42 is pivoted to a position indicated by a chain double-dashed line, by contact with a sheet that is transported downward from the bifurcation 24 along the path 12.

A guide 44 is provided at the bifurcation 26. A sheet reversed in the section 12A is never delivered to the tray 38 through the paths 12 and 15. Thus, the roller 58 is rotatable in one direction only, and the guide 44 is urged to a position indicated by a solid line by an elastic member. The elastic member exerts such an elastic force on the guide 44 as to allow the guide 44 to be pivoted to a position indicated by a chain double-dashed line by contact with a sheet that is transported to the portion 12A through the paths 11 and 12. In the bifurcation 26, accordingly, the guide 44 selectively allows passage of a sheet from the path 12 to the path 13, or through the path 12.

The apparatus 100 is designed to perform three types of sheet transport processes: a normal transport process; a face-down transport process; and a reverse transport process. In the normal transport process, a sheet is transported on the path 11, undergoes image recording process on a single side thereof, and then is output to the tray 38 with the image-recorded side facing up. In the face-down transport process, a sheet is output to the tray 38 with an image-recorded side facing the tray 38 so that the image-recorded side cannot be seen. In the reverse transport process, a sheet undergoes image recording process on both sides thereof.

The face-down transport process is performed as follows. After undergoing image recording process in the section 30, a sheet is transported through the first bifurcation 24, the path 12, the section 12A, the path 12, the second bifurcation 25, the path 15, and the second confluence 22, in that order, and then output to the tray 38. Alternatively, the face-down transport process can be performed as follows. After undergoing image recording process in the section 30, a sheet is transported through the bifurcation 24, the path 12, the bifurcation 25, the path 14, the path 13, the path 14, the bifurcation 25, the path 15, and the confluence 22, in that order.

Meanwhile, the reverse transport process is performed as follows. After undergoing image recording process on a first side in the section 30, a sheet is transported through the bifurcation 24, the path 12, the section 12A, the path 12, the third bifurcation 26, the first confluence 21, and the path 11, in that order, to be reversed. Then, the sheet undergoes image recording process on a second side in the section 30, and output to the tray 38.

It is to be noted that the path leading from the bifurcation 24 to the confluence 21 through the paths 12 and 13 in the reverse transport operation corresponds to the second path of the Claims as the reversing transport path.

Figure 4:
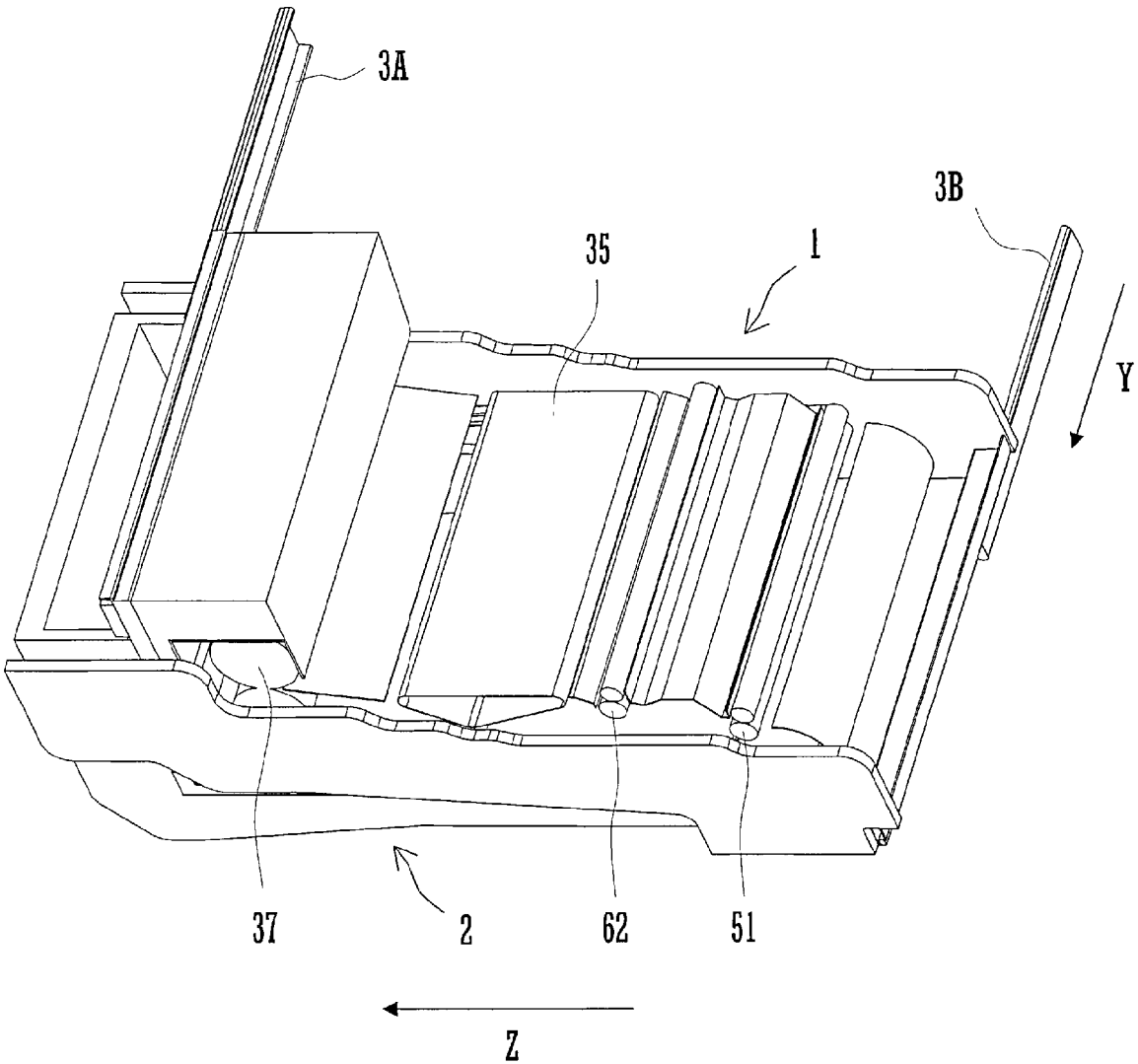
FIG. 4 is an external view of the apparatus illustrating a first unit, and a second unit, as drawn out of the apparatus.

FIG. 4 is an external view illustrating a first unit 1, and a second unit 2, drawn out of the apparatus 100. The units 1 and 2 are mounted inside the apparatus 100. In the first unit 1, the transfer belt 35 and the transfer roller 35A are positioned. The unit 1 is slidably supported by sliding rail assemblies 3A and 3B. The assemblies 3A and 3B allow the unit 1 to be brought out of the apparatus 100 by being pulled in a direction of arrow Y toward the front (i.e., the outside) of the apparatus 100. The direction of arrow Y corresponds to the first direction of the Claims.

Figure 6:
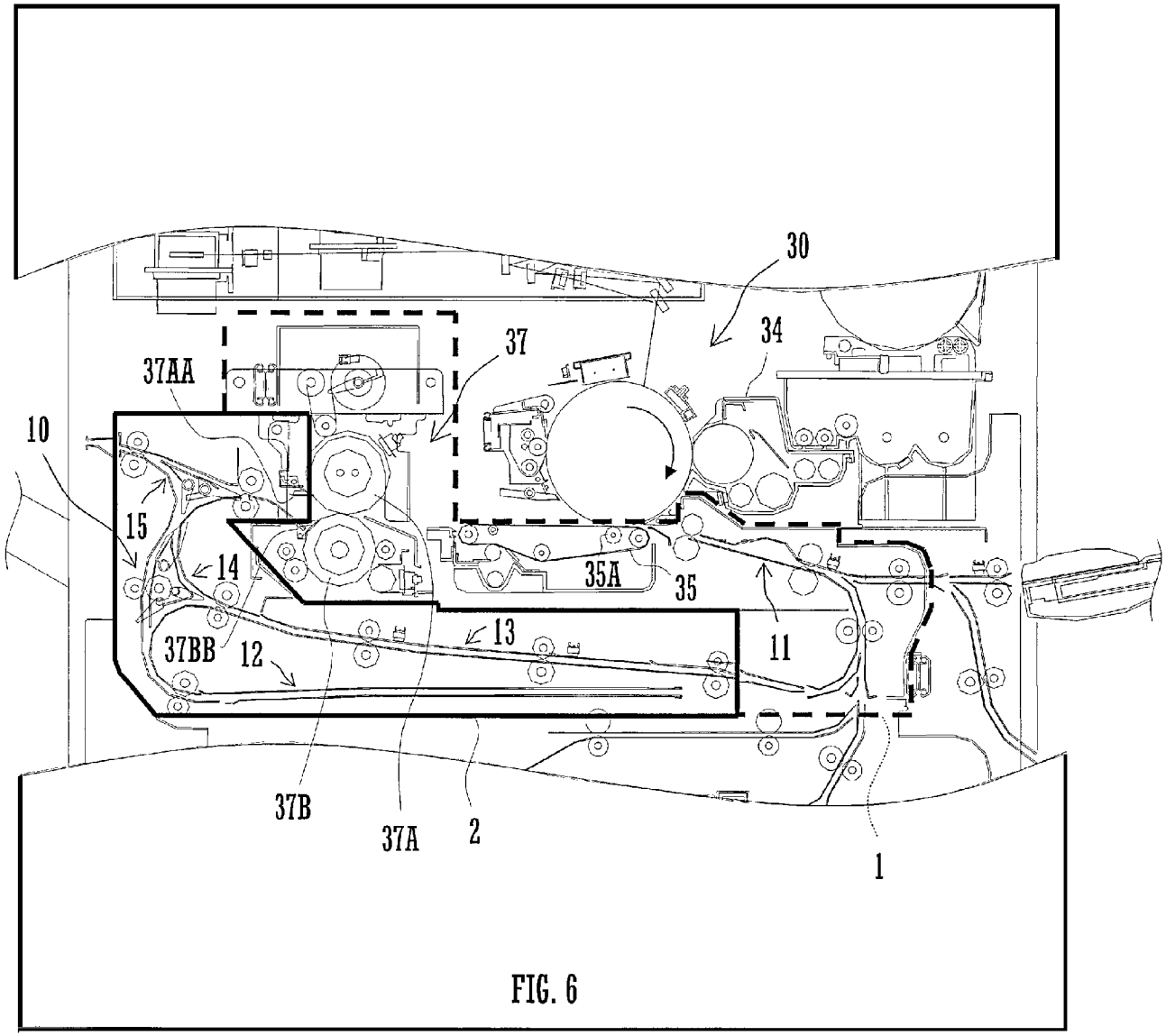
FIG. 6 is an enlarged schematic partial view of the apparatus.

In the unit 1, referring to FIG. 6, the portion of the first path 11 located in the section 30, and a portion of the third path 13, are positioned. When the unit 1 is drawn out of the apparatus 100, the portion of the path 11 located in the section 30 is exposed, as shown in FIG. 4. In the event of sheet jam or the like, thus, a user can easily check whether a sheet is present or absent in the portion, and, if necessary, remove a sheet present in the portion, by merely drawing the unit 1 out of the apparatus 100.

The fusing device 37 is divided into a first portion and a second portion. Referring to FIG. 6, the first portion is positioned in the unit 1. In the first portion, the heat roller 37A and the pressure roller 37B are located.

Referring to FIG. 6, the second unit 2 has a portion of the path 11, the entire path 12, a portion of the path 13, the entire path 14, and the entire path 15, positioned therein. Referring back to FIG. 5, the unit 2 is slidably supported by sliding rail assemblies 4A and 4B. With the unit 1 drawn out of the apparatus 100 as shown in FIG. 4, the unit 2 can be drawn out of the unit 1 by being moved in the direction of arrow Z, which is perpendicular to the direction of arrow Y. In the present embodiment, a precision ball bearing slide rail assembly is used as each of the assemblies 3A, 3B, 4A, and 4B.

Figure 7:
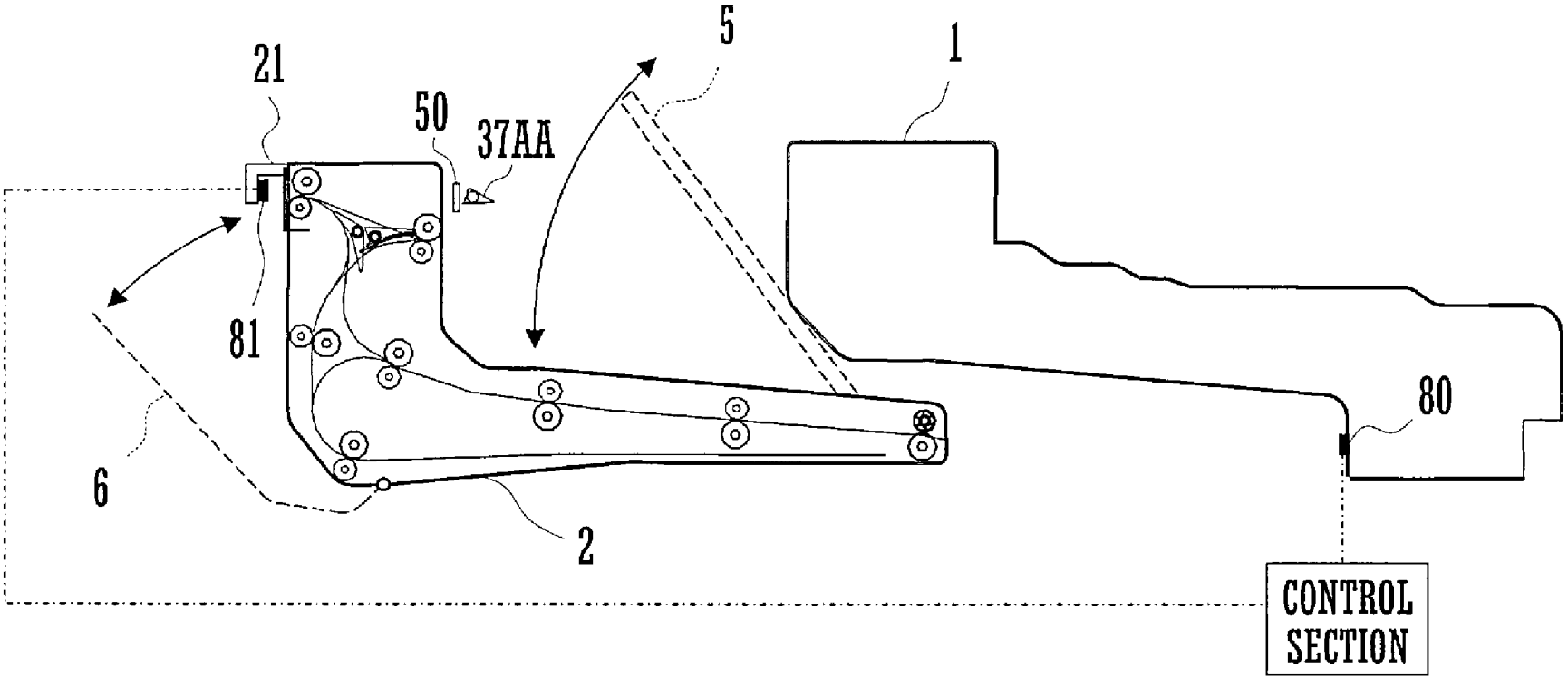
FIG. 7 is a schematic drawing illustrating a configuration of the second unit.

Referring to FIG. 7, the unit 2 has an upper movable plate 5 and a side movable plate 6. With the unit 2 drawn out of the unit 1, each of the plates 5 and 6 is rendered pivotable between a closed position and an open position indicated by a solid line and a broken line, respectively. The plates 5 and 6 are pivoted to the open positions to expose a portion of the path 12 and a portion of the path 13.

A sheet jam is relatively more likely to occur in the first bifurcation 24, the second bifurcation 25, and the third bifurcation 26, which are arranged in that order along the portion of the path 12. The plate 6 is pivoted to the open position to expose all of the bifurcations 24 to 26 and provide access to the bifurcations 24 to 26. This facilitates removal of a sheet present in the paths 12 and 13 in the event of a sheet jam.

In the unit 2, the second portion of the fusing device 37 is positioned. In the second portion located are components such as a sheet remover 37AA as an example of the contact member of the claims. The second portion is detachable from the first portion as the unit 2 is drawn out from the unit 1. The remover 37AA is positioned in contact with the roller 37A in order to remove a sheet that has passed between the rollers 37A and 37B, from a circumferential surface of the roller 37A.

Figure 5:
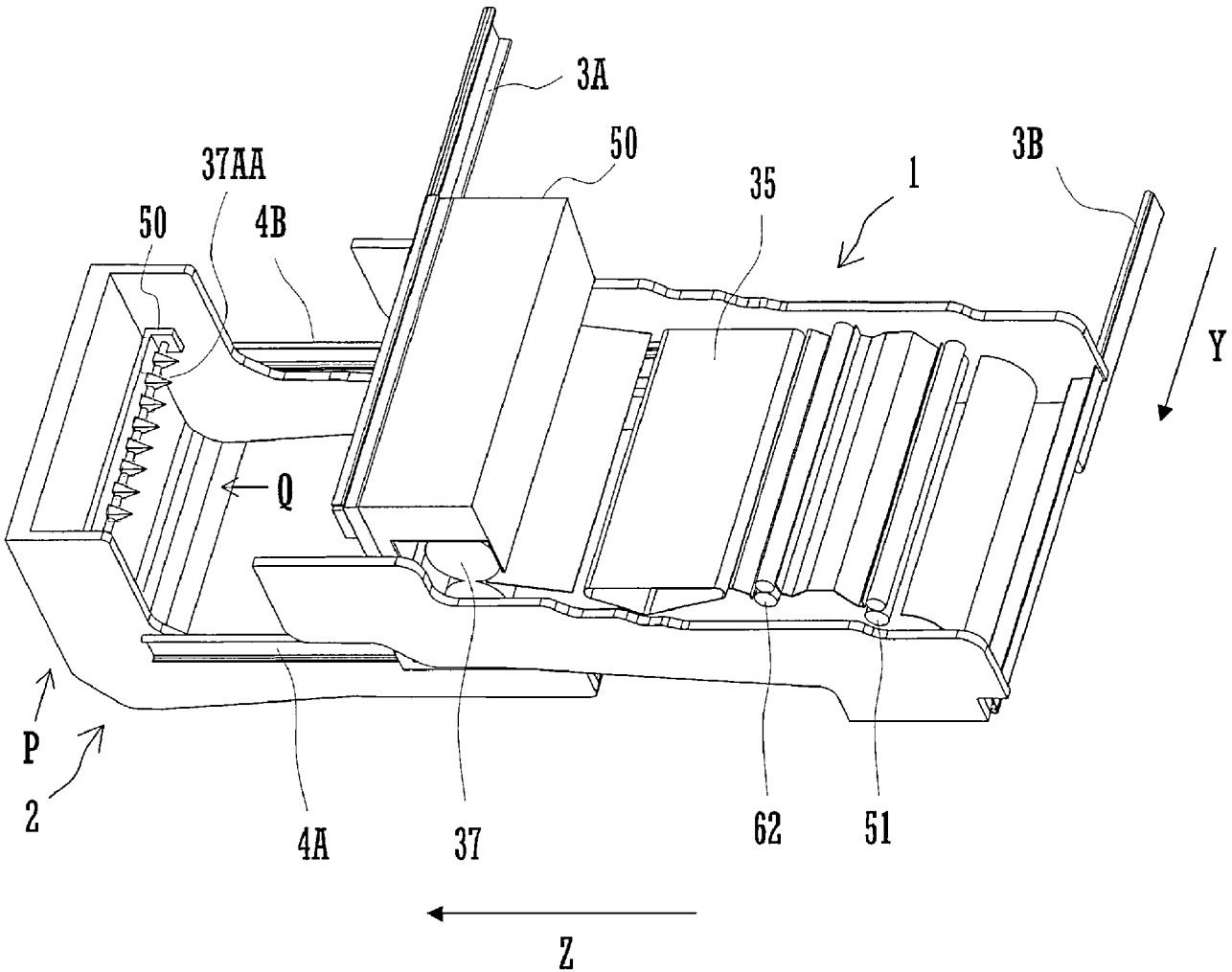
FIG. 5 is an external view of the apparatus illustrating the second unit drawn out of the first unit.

When the unit 2 is drawn out from the unit 1, referring to FIG. 5, the remover 37AA is moved away from the first portion of the fusing device 37, together with part of a covering 50 that prevents radiation of heat from the roller 37A or the like.

This exposes the circumferential surface of the roller 37A, as well as a jammed sheet adhering to the circumferential surface. Moving the remover 37AA away from the circumferential surface of the roller 37A is effective in facilitating exposure, and therefore removal, of a jammed sheet. This is particularly because a sheet jammed in the device 37 often adheres to the circumferential surface of the roller 37A. Accordingly, the configuration of the present embodiment facilitates removal of a jammed sheet from the fusing device 37.

In the present embodiment, the remover 37AA is located in the second portion of the fusing device 37. However, the contact member includes, but is not limited to, the remover 37AA. As the contact member, any member positioned in the second portion suffices, provided that the member comes into contact with the circumferential surface of the heat roller 37A when the second portion is attached to the first position and that the member is brought out of contact with, and thus exposes, the circumferential surface when the second portion is detached from the first portion.

Also, the contact member includes, but is not limited to, one that is to come into contact with the circumferential surface of the roller 37A. Any member positioned in the second portion also suffices, provided that the member comes into contact with the circumferential surface of the pressure roller 37B when the second portion is attached to the first portion and that the member is brought out of contact with, and thus exposes, the circumferential surface when the second portion is detached from the first portion. An example of such member is a sheet remover 37BB, as shown in FIG. 6, that is placed in contact with the circumferential surface of the roller 37B.

Figure 8A:
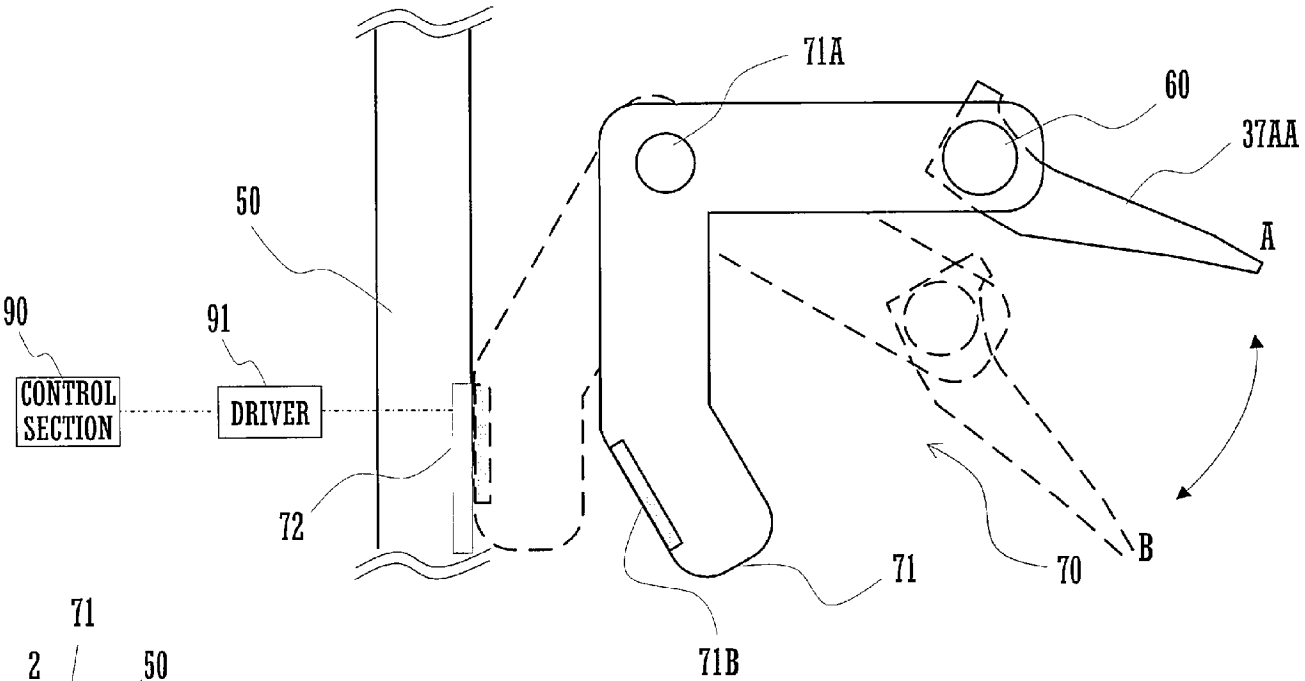
FIGS. 8A and 8B are drawings for illustrating a configuration of a sheet remover.
Figure 8B:
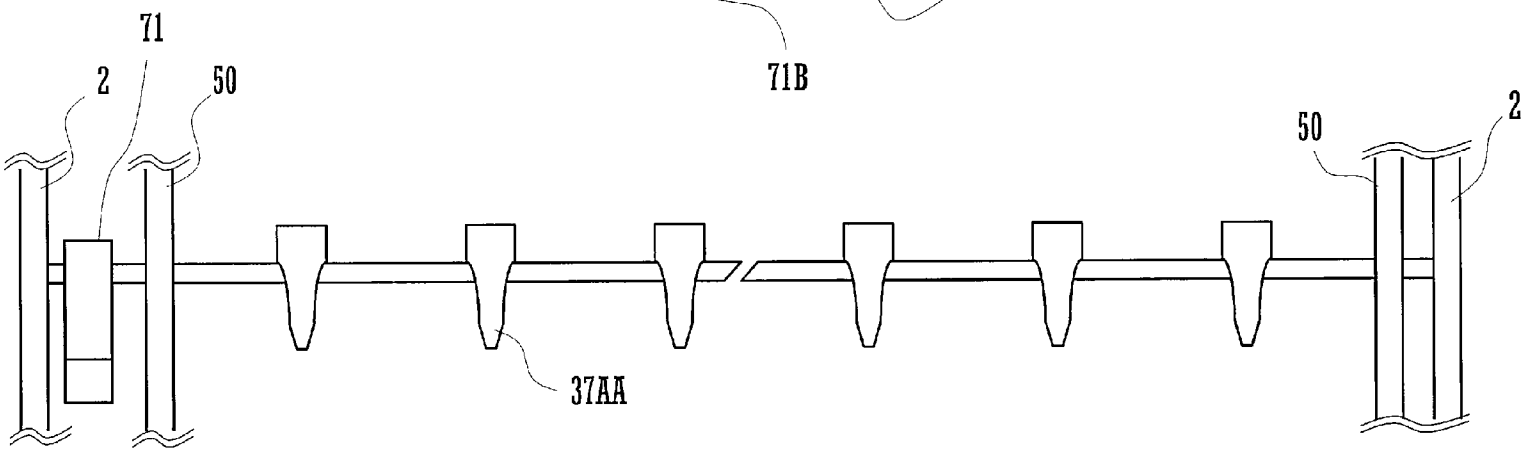

A configuration of the sheet remover 37AA is illustrated in FIGS. 8A and 8B. FIG. 8A is a view of the remover 37AA from a direction of arrow P shown in FIG. 5. FIG. 8B is a view of the remover 37AA from a direction of arrow Q shown in FIG. 5. In FIG. 8A, the unit 2 is not shown for simplification.

Referring to FIGS. 8A and 8B, the remover 37AA is supported by a shaft 60. The shaft 60 corresponds to the support of the Claims. A separating mechanism 70 is mounted on an end of the shaft 60. The mechanism 70 includes a lever 71 and an electromagnet 72. The mechanism 70 renders the remover 37AA movable between a contact position A and a distant position B. In the contact position A, the remover 37AA is in contact with the circumferential surface of the heat roller 37A with the unit 2 entirely inserted in the unit 1. In the distant position B, the remover 37AA is away from, and out of contact with, the circumferential surface of the roller 37A with the unit 2 drawn out of the unit 1.

The lever 71 is substantially L-shaped and is supported rotatably about an axis 71A. The lever 71 supports the shaft 60 on one end, and has a metal piece 71B attached to the other end. The lever 71 is urged by a spring (not shown) in such a direction as to move the remover 37AA from the position B to the position A.

The electromagnet 72 is connected to a control section 90 through a driver 91. The electromagnet 72 is turned on and off by the section 90. The section 90 has overall control of the apparatus 100. Referring to FIG. 7, sensors 80 and 81 are connected to the section 90. Based on detection results of the sensors 80 and 81, the section 90 controls on-off of the electromagnet 72.

The sensor 80, which is a contact sensor, is mounted on the unit 1. The sensor 80 detects contact with the unit 2, thereby determining that the unit 2 is entirely inserted in the unit 1. The sensor 81, which is also a contact sensor, is mounted on a handle 21 that is provided on the unit 2. The sensor 81 detects the grip of a user on the handle 21. The sensor 81 corresponds to the detection means of the Claims. As the sensors 80 and 81, noncontact sensors may be alternatively used.

Based on the detection results of the sensors 80 and 81, the section 90 determines whether the unit 2 is about to be drawn out from the unit 1. More specifically, the section 90 determines that a user is about to draw the unit 2 out from the unit 1, when the sensor 80 detects that the unit 2 has been fully inserted in the unit 1 and the sensor 81 detects the grip of the user on the handle 21. This is because a grip on the handle 21 with the unit 2 fully inserted in the unit 1 indicates that the unit 2 is about to be drawn out.

Figure 9:
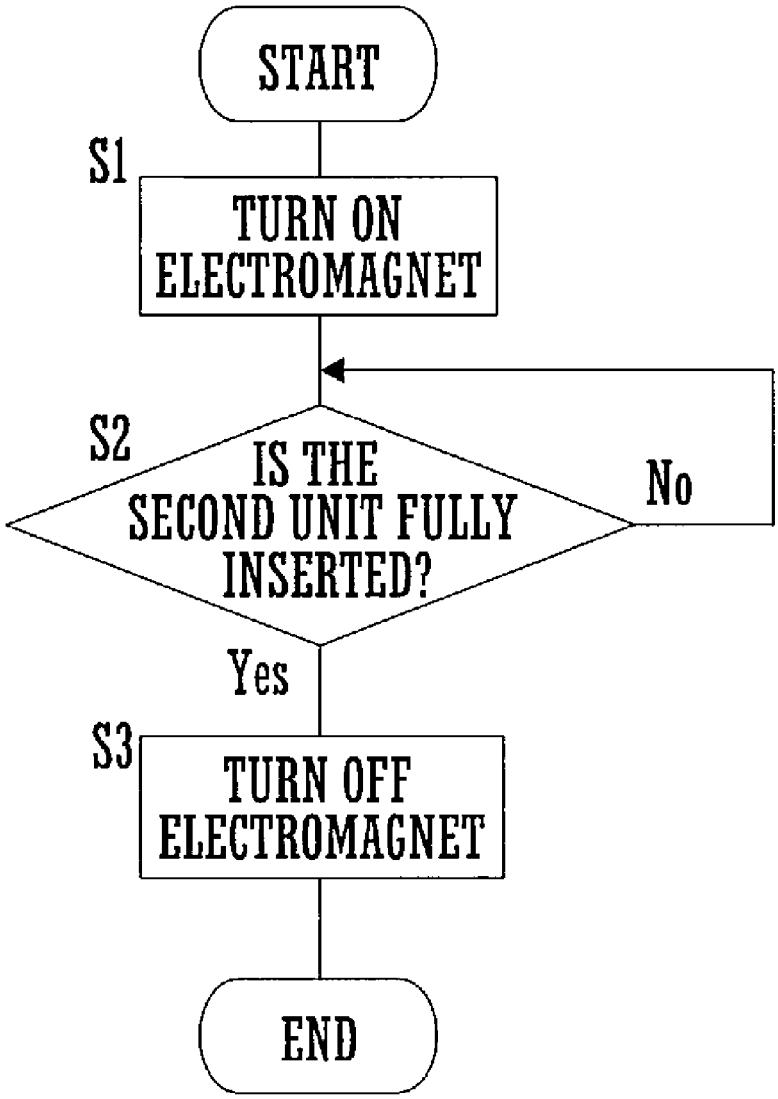
FIG. 9 is a flowchart for illustrating a process in which the remover is moved.
Figure 10B:
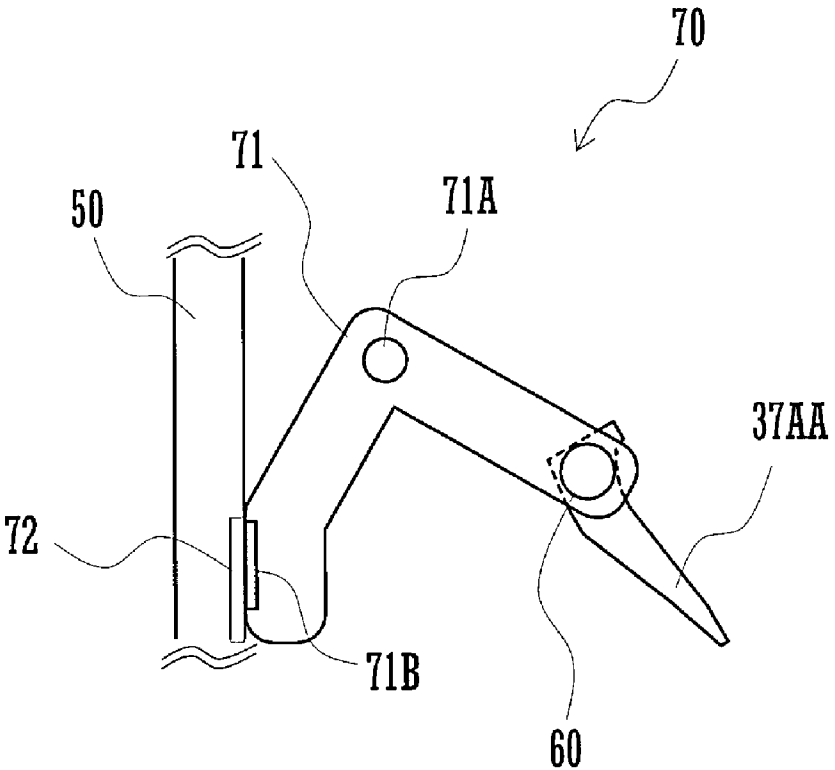
FIGS. 10A and 10B are drawings for illustrating the sheet remover in a contact position and in a distant position.
Figure 10A:
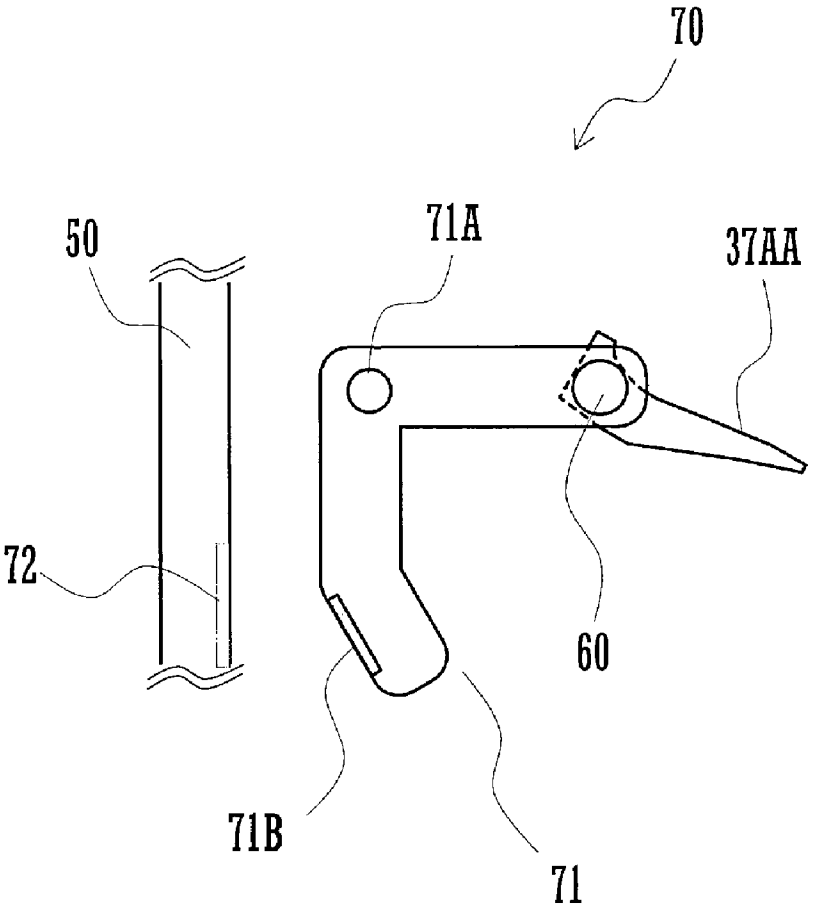

FIG. 9 is a flowchart for illustrating a process of moving the remover 37AA. When determining, based on the detection results of the sensors 80 and 81, that the unit 2 has been, or is about to be, drawn out of the unit 1, the section 90 turns on the electromagnet 72 (step S1). The piece 71B is thus attracted to the electromagnet 72, so that the lever 71 is rotated to move the remover 37AA from the contact position A shown in FIG. 10A to the distant position B shown in FIG. 10B.

The remover 37AA is configured so as to be moved to the position B even when it is determined that the unit 2 is about to be drawn out from the unit 1, for the following reason. The detection of grip on the handle 21 is made at an earlier time than the determination that the unit 2 has been drawn out of the unit 1. Thus, it can be almost always detected reliably that the unit 2 is about to be drawn out from the unit 1, whereas it is sometimes hard to determine that the unit 2 has been drawn out of the unit 1, in a situation such as where the unit 2 is drawn out slightly from the unit 1 and then inserted again into the unit 1. As an alternative to the configuration described above, only the sensor 80 may be used, without the use of the sensor 81.

Next, the section 90 determines whether the unit 2 has been fully inserted in the unit 1 (step S2), and waits until the unit 2 is fully inserted in the unit 1. More specifically, the section 90 determines that the unit 2 has been fully inserted in the unit 1, when the sensor 80 detects the unit 2 inserted in the unit 1 and the sensor 81 does not detect a user touching the handle 21.

When determining in step S2 that the unit 2 has been fully inserted in the unit 1, the section 90 turns off the electromagnet 72 (step S3) and terminates the process. Thus, the metal piece 71B is moved in a direction away from the electromagnet 72 by the urging force of the spring, so that the lever 71 is rotated to move the remover 37AA from the position B shown in FIG. 10B to the position A shown in FIG. 10A.

The remover 37AA is moved from the position B to the position A after the unit 2 has been fully inserted in the unit 1. This prevents potential damage to the remover 37AA due to collision with the circumferential surface of the roller 37A caused by inserting the unit 2 into the unit 1 with the remover 37AA in the position A.

Moving the remover 37AA to the position B when the unit 2 is drawn out from the unit 1 ensures that the remover 37AA is in the position B when the unit 2 is fully inserted into the unit 1. This allows simplified control of the timing at which the remover 37AA is to be moved to the position B.

It is to be noted that the separating mechanism 70, the sensor 80, and the control section 90 collectively correspond to the separating means of the Claims.

In the present embodiment, the remover 37AA is moved to the position B when the unit 2 is about to be drawn out from the unit 1 and remains in the position B during a period when the unit 2 is out of the unit 1. However, positioning of the remover 37AA includes, but is not limited to, the foregoing. It is only necessary for the remover 37AA to be located in the position B when the unit 2 is entirely inserted into the unit 1 and to be moved to the position A after the unit 2 has been inserted in the unit 1.

Now, an image recording apparatus according to a second embodiment of the invention will be described below. Referring to FIG. 12A, the apparatus 100 has such a configuration that a sheet remover 370AA is retractable into a cover 381. The configuration is otherwise similar to that of the first embodiment.

Figure 11:
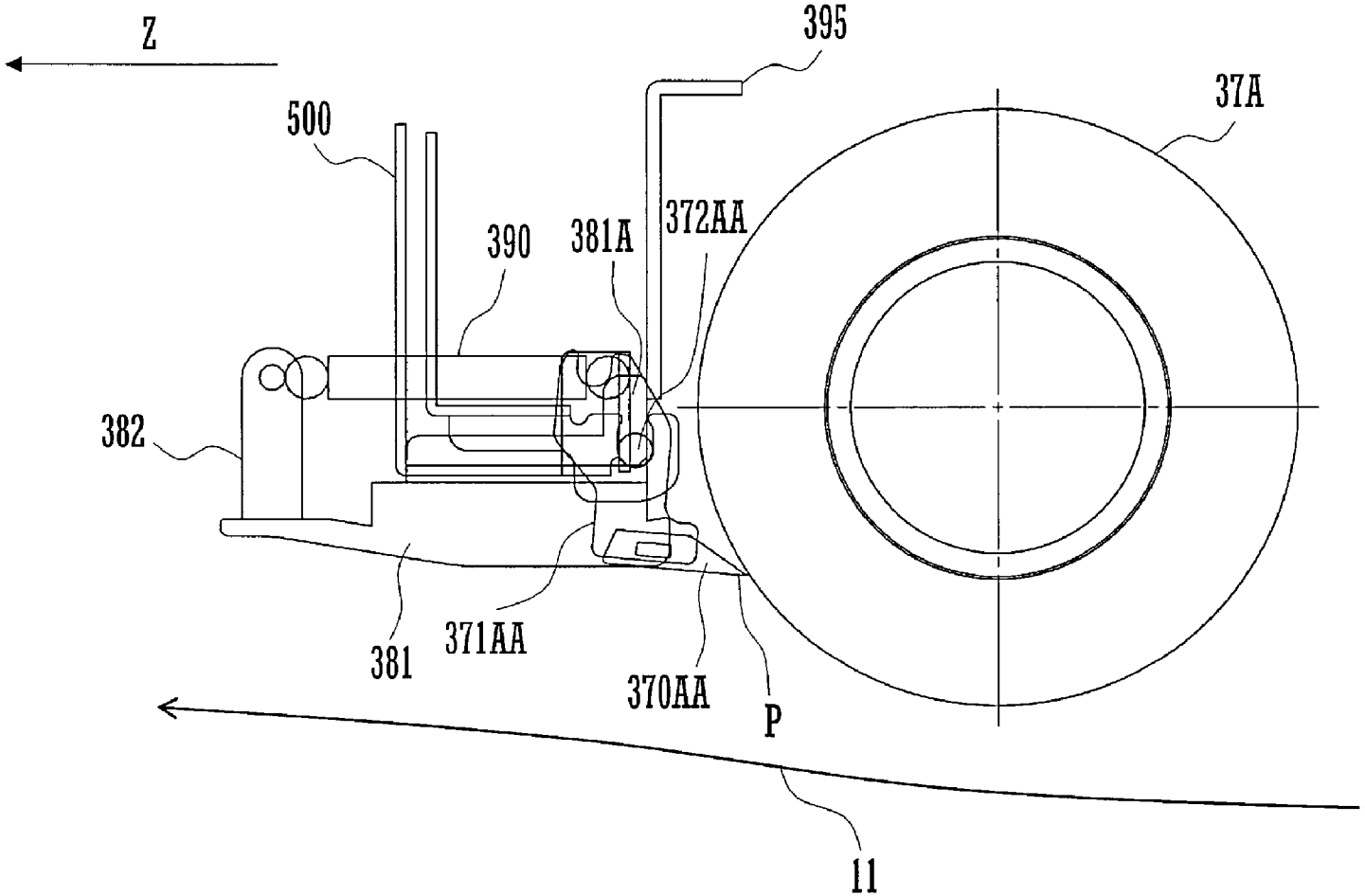
FIG. 11 is a side cross-sectional view illustrating a relevant part of a fusing device.
Figure 12:
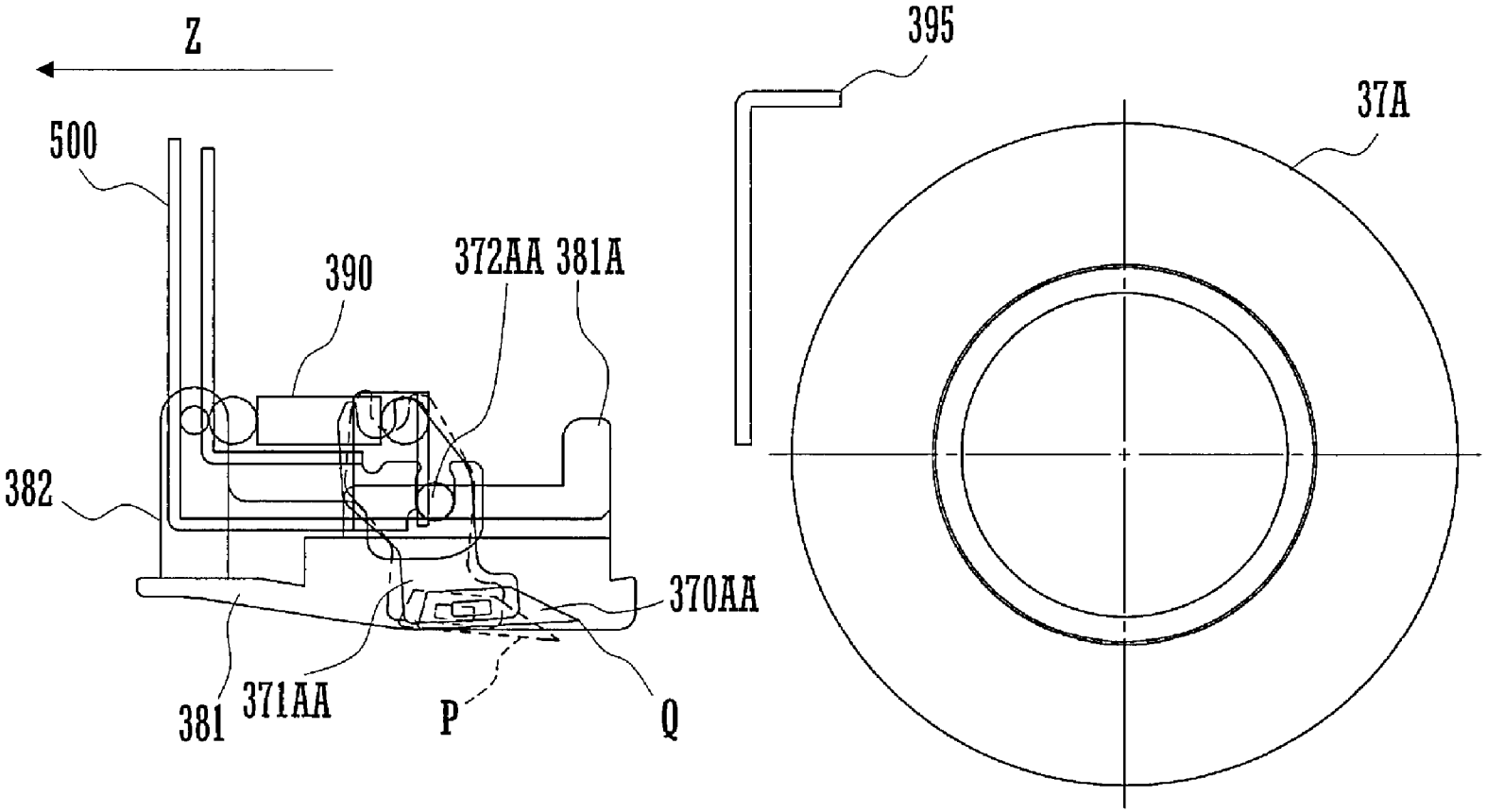
FIG. 12 is a side cross-sectional view illustrating the relevant part of the fusing device.

FIG. 11 and FIG. 12 are side cross-sectional views illustrating a relevant part of a fusing device 37. In FIG. 11, a second unit 2 is fully inserted in a first unit 1. In FIG. 12, the unit 2 is drawn out of the unit 1.

The remover 370AA is mounted on an end of a movable member 371AA. The member 371AA is rotatably supported about a rotation shaft 372AA located approximately at its center. The shaft 372AA is supported by a covering 500 that prevents radiation of heat from the roller 37A or the like. The covering 500 is secured to the unit 2 and, thus, is moved together with the unit 2. The member 371AA is rotated to move the remover 370AA between a contact position P and a retracted position Q shown in FIG. 12. With the unit 2 entirely inserted in the unit 1, the covering 500 serves as part of a covering (not shown) that covers the entire fusing device 37.

The cover 381 has a connecting member 382. The cover 381 is movable along a direction of arrow Z.

From a top view, the cover 381 is shaped like a comb with several teeth. The remover 370AA is to be retracted into openings between the teeth. The member 382 holds the cover 381 to its lower end. The member 382 is supported slidably along the direction of arrow Z on a guide rail (not shown) attached to its upper end. The guide rail is supported by the covering 500. The member 382 is urged by a spring 390 attached to the member 371AA in a direction toward a heat roller 37A, i.e., in a direction opposite to the direction of arrow Z.

In the unit 1, a pressure member 395 is provided so as to face the covering 500. The member 395 is a panel for pressing against a projection 381A formed on an upper part of the cover 381. The member 395 serves as a blocking member that prevents the cover 381 from being moved therebeyond in the direction opposite to the direction of arrow Z. The spring 390 and the member 395 collectively correspond to the covering mechanism of the Claims. Also, the spring 390 corresponds to the urging means of the Claims.

When the unit 2 is drawn out from the unit 1 to shift from the state in FIG. 11 to the state in FIG. 12, the remover 370AA is moved away from the roller 37A, i.e., in the direction of arrow Z. In the meanwhile, the cover 381 is moved by the urging force of the spring 390 in the direction opposite to the direction of arrow Z. This causes an end of the cover 381 on the side of the roller 37A to be located between the remover 370AA and the roller 37A.

Also, the remover 370AA is moved from the contact position P to the retracted position Q by rotation of the member 371AA due to the urging force of the spring 390. Thus, the remover 370AA is fully retracted into the openings between the teeth of the cover 381.

When the unit 2 is fully inserted into the unit 1 to shift from the state in FIG. 12 to the state in FIG. 11, on the other hand, the remover 370AA is moved in the direction opposite to the direction of arrow Z.

In the meanwhile, the cover 381 is moved together with the unit 2 by the urging force of the spring 390, until the projection 381A hits the member 395. The cover 381 is pressed back, against the urging force, by the member 395, and comes to a halt, as shown in FIG. 11. Thus, the remover 370AA is brought out of the cover 381 and into contact with the circumferential surface of the roller 37A. In other words, the remover 370AA is moved, against the urging force, from the retracted position Q to the contact position P to have contact with the circumferential surface of the roller 37A.

When fully inserted in the unit 1, the unit 2 is locked by a stopper mechanism (not shown) so as not to be detached from the unit 1 by the urging force of the spring 390. The unit 2 is unlocked by being pulled with a predetermined amount of force, to be able to be drawn out from the unit 1. As the stopper mechanism, magnets are usable that are provided in the units 1 and 2, respectively, at such locations as to face each other when the unit 2 is entirely inserted in the unit 1.

The foregoing configuration, as well as the configuration according to the first embodiment, facilitates removal of a sheet jammed in the fusing device 37. Also, drawing the unit 2 out of the unit 1 causes the end of the cover 381 on the side of the roller 37A to be located between the remover 370AA and the roller 37A, thereby retracting the remover 370AA in the cover 381. Thus, the remover 370AA is prevented from being touched by a user who tries to remove a jammed sheet on the circumferential surface of the roller 37A. This prevents damage to the remover 370AA.

Further, the cover 381 is urged by the spring 390 in the direction toward the roller 37A, i.e., in the direction opposite to the direction of arrow Z, and the member 395 limits the range of movement of the cover 381 toward the roller 37A. This simple configuration allows the end of the cover 381 on the side of the roller 37A to be moved away from between the remover 370AA and the roller 37A.

According to the second embodiment, the cover 381 is positioned outside the path 11 with the unit 2 inserted in the unit 1. The cover 381 also serves to guide a sheet that has passed between the heat roller 37A and the pressure roller 37B, along the path 11. Thus, the cover 381 does not prevent sheet transport on the path 11. Also, the guide 381 eliminates the need for providing a guide member separately, thereby preventing upsizing of the apparatus 100.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image recording apparatus, comprising:

a fusing device including:

a heat roller for fusing a toner image formed on a sheet;

a pressure roller, pressed against the heat roller, for applying pressure to the sheet; and a contact member placed in contact with the heat roller, the fusing device fixing the toner image on the sheet being transported between the heat roller and the pressure roller;

a first unit movable along a first direction toward front of the apparatus, to be drawn out of the apparatus; and a second unit mounted in the first unit, the second unit being horizontally reciprocatable, with the first unit drawn out of the apparatus, along a second direction that is perpendicular to the first direction, wherein:

the fusing device is divided into a first portion where the pressure roller and the heat roller are located and a second portion where the contact member is located, the first portion is supported on the first unit, and the second portion is supported on the second unit in such a manner as to be detached from the first portion when the second unit is drawn out from the first unit.

2. An image recording apparatus, comprising:

a fusing device including:

a heat roller for fusing a toner image formed on a sheet;

a pressure roller, pressed against the heat roller, for applying pressure to the sheet; and a contact member placed in contact with the pressure roller, the fusing device fixing the toner image on the sheet being transported between the heat roller and the pressure roller;

a first unit movable along a first direction toward front of the apparatus, to be drawn out of the apparatus; and a second unit mounted in the first unit, the second unit being horizontally reciprocatable, with the first unit drawn out of the apparatus, along a second direction that is perpendicular to the first direction, wherein:

the fusing device is divided into a first portion where the pressure roller and the heat roller are located and a second portion where the contact member is located, the first portion is supported on the first unit, and the second portion is supported on the second unit in such a manner as to be detached from the first portion when the second unit is drawn out from the first unit.

3. The image recording apparatus according to claim 1, further comprising:

a support for supporting the contact member in such a manner that, with the second unit fully inserted in the first unit, the contact member is movable between a contact position where the contact member is in contact with a circumferential surface of the heat roller and a distant position where the contact member is out of contact with the circumferential surface of the heat roller; and separating means for determining whether the second unit is drawn out of the first unit and, based on the determination result, moving the contact member from the distant position to the contact position after the second unit is fully inserted in the first unit.

4. The image recording apparatus according to claim 3, wherein the separating means includes:

a rotatable lever that supports the contact member on a first end, the lever being urged in such a manner that the contact member rotates from the distant position to the contact position;

a metal niece disposed on a second end of the lever;

an electromagnet for attracting the metal piece in such a manner that the contact member rotates from the contact position to the distant position; and a control section configured to turn on or off the electromagnet, and wherein the separating means moves the contact member from the contact position to the distant position when the second unit is drawn out from the first unit.

5. The image recording apparatus according to claim 4, wherein:

the second unit has: a handle for use in drawing the second unit out from the first unit; and detection means for detecting a grip of a user on the handle, and the separating means moves the contact member selectively to the contact position and the distant position according to a result of detection by the detecting means and a result of determination as to whether the second unit is drawn out of the first unit.

6. The image recording apparatus according to claim 1, wherein the contact member is a sheet remover, positioned in contact with the circumferential surface of the heat roller, for removing a sheet from the circumferential surface.

7. The image recording apparatus according to claim 1, further comprising a sheet transport path on which a sheet is transported from a sheet feeding section to a sheet output section through the fusing device, the sheet transport path including a first path and a second path, wherein:

the first path is positioned in the first unit, and the second path is positioned in the second unit.

8. The image recording apparatus according to claim 1, wherein the second unit has:

a cover movable along the second direction; and a covering mechanism adapted to move the cover, when the second unit is drawn out of the first unit, so that an end of the cover on a side of the heat roller is located between the contact member and the heat roller, and to move the cover, when the second unit is inserted in the first unit, so that the end of the cover on the side of the heat roller is moved away from between the contact member and the heat roller.

9. The image recording apparatus according to claim 8, wherein the covering mechanism has:

urging means for urging the cover in a direction toward the heat roller; and a pressure member, secured to the first unit, for pressing the cover, against a force of the urging means, in a direction away from the heat roller when the second unit is inserted into the first unit.

10. The image recording apparatus according to claim 8, further comprising a sheet transport path on which a sheet is transported from a sheet feeding section to a sheet output section through the fusing device, wherein the cover is positioned outside the sheet transport path when the second unit is inserted in the first unit.

11. The image recording apparatus according to claim 8, further comprising a guide member for guiding a sheet that has passed between the heat roller and the pressure member, wherein the cover serves as at least part of the guide member when the second unit is fully inserted in the first unit.

* * * * *